United States Patent [19]

Moller

[11] 3,974,931

[45] Aug. 17, 1976

[54] BOTTLE CAP

[75] Inventor: Thomas G. Moller, Rahway, N.J.

[73] Assignee: American Flange & Manufacturing Co., Inc., New York, N.Y.

[22] Filed: May 29, 1975

[21] Appl. No.: 581,881

[52] U.S. Cl. ..... 215/254

[51] Int. Cl.[2] ..... B65D 41/42

[58] Field of Search ..... 215/253, 254, 256, 257

[56] References Cited

UNITED STATES PATENTS

| | | | |
|---|---|---|---|
| 1,052,382 | 2/1913 | Schmitt | 215/254 |
| 2,068,444 | 1/1937 | Breckenridge | 215/254 |
| 3,130,056 | 4/1964 | Taylor | 215/254 X |
| 3,216,602 | 11/1965 | Koll | 215/254 |
| 3,258,149 | 6/1966 | Wheaton | 215/254 |
| 3,380,609 | 4/1968 | Potts | 215/254 |
| 3,397,661 | 8/1968 | Allman | 215/254 X |
| 3,785,519 | 1/1974 | Huh | 215/254 |

*Primary Examiner*—Donald F. Norton

[57] ABSTRACT

A tear-off convenience bottle cap formed of lightweight sheet metal having a circular top panel surrounded by a cylindrical skirt. An annular sealing gasket disposed within said cap at the juncture of the top and skirt. An integrally formed pull member extends away from the skirt edge with a score line commencing at either side of the pull member extending upwardly across the cap skirt. The score lines continue part way about the periphery of the cap top panel protected against exposure to the bottle contents by the annular sealing gasket and are then directed radially outwardly into the cap skirt opposite the pull member, thus minimizing the pull force required to dislodge the cap from the underlying bottle finish at the termination of the tearing action.

7 Claims, 4 Drawing Figures

Fig. 1.
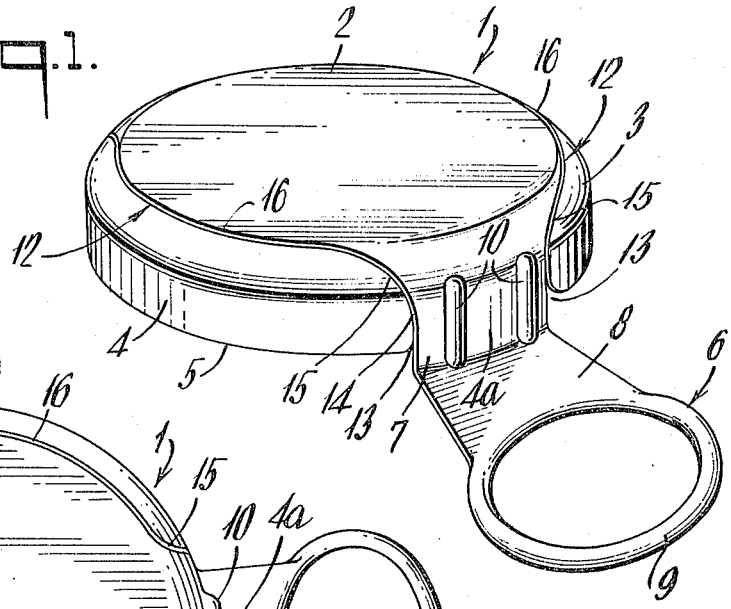
Fig. 2.
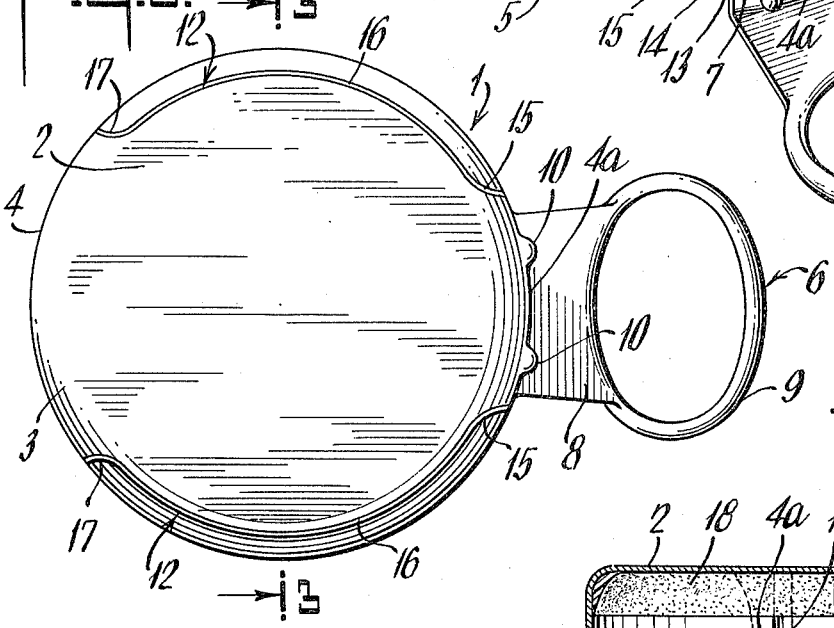
Fig. 3.
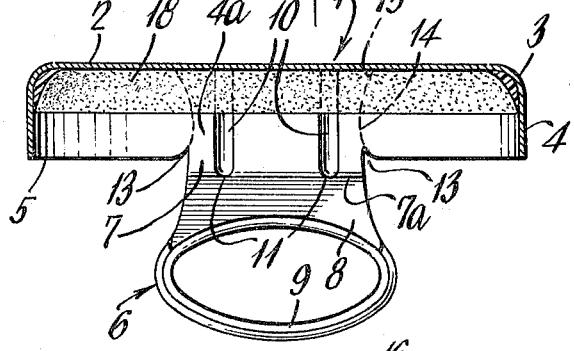
Fig. 5.
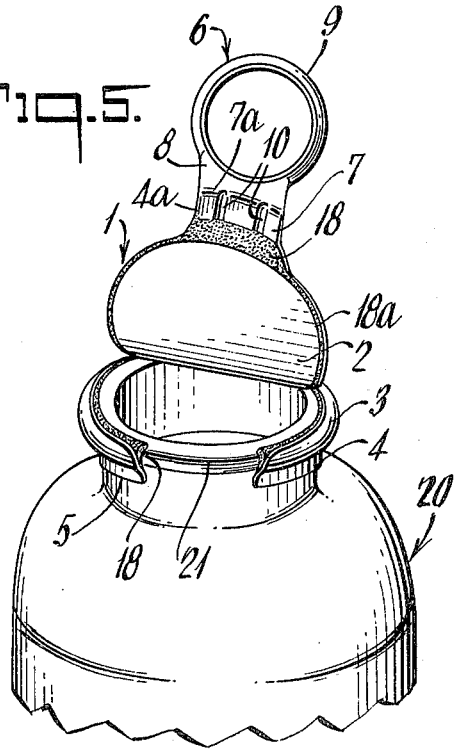
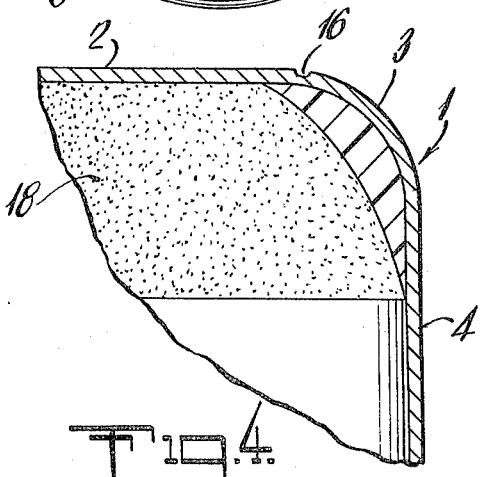
Fig. 4.

BOTTLE CAP

BACKGROUND OF THE INVENTION

This invention is concerned with the structural improvement of tear-off convenience bottle caps formed out of lightweight sheet metal. The desirability of effecting further refinement in existing tear-off bottle caps becomes more self-evident as their general usage increases. This growth being due in part to recyclable or reusable glass containers as well as the constant consumer demand for convenience packaging. One aspect of known tear-off bottle caps where the need for further refinement has become particularly apparent concerns the easy removal of the cap from the underlying bottle lip or finish at the termination of the tearing action. Such removal, for optimum consumer acceptance, must be effected with minimal effort to avoid spillage and the mess attendant thereto resulting from the instability of the bottle and its attached cap caused by the applied pressure to remove the cap from the bottle. Variations in tearing pattern as determined by existing score line configurations have not, as yet completely fulfilled the above mentioned need in that the other basic structural requirements of the cap must still be met at the same time removal is being eased. Consequently, optimum positioning of the cap scoring must advantageously provide for adequate pressure retention as well as ease of tearing prior to cap removal and finally ease of cap removal from the bottle lip.

Another aspect of prior art tear-off bottle caps susceptible of further refinement concerns the degree of rigidity imparted to the cap in its fabrication so as to effectively withstand the rigors and abuse of in-process handling and shipment. This aspect has particular significance in cap constructions employing a radially extending gripping ear which not only required a substantial degree of stability for efficient high speed handling operations but must, in addition, possess sufficient stiffening to effectively aid the tearing action.

SUMMARY

The bottole cap herein disclosed seeks to improve upon the prior art constructions in providing a score line configuration having portions which closely follow along the periphery of cap top panel. This particular scoring pattern offers the advantage of allowing the major part of the cap top panel to be lifted upwardly off of the underlying bottle finish as the cap is being torn open, leaving only a very narrow surrounding portion of the cap body for easy dislodgement from the bottle at the termination of the tearing action. Also of importance is the exact positioning of the score lines so as to avoid any weakening of the more critical formed portions of the cap body surrounding the center panel. With the score line placed in accordance with the invention, any detrimental effect from the normal stress and strain of cap forming and subsequent applying is avoided. Moreover, positioning of the circular score line portions relative to the annular sealing gasket formed in situ on the cap interior is such as to shield any exposed metal at the score and protect the same from product attack while at the same time holding to a minimum the thickness of gasketing material to be torn through for cap removal. In addition, stiffening ribs are provided in the tear-out segment of the cap skirt so as to lend a desirable degree of rigidity to the gripping ear during cap handling operations and cap removal.

It is, accordingly, a principal object of the invention to provide an improved lightweight metal tear-off convenience closure for bottled products.

Another object is to provide a metal tear-off closure having an improved score pattern which substantially reduces the pull force required to dislodge a torn open closure from the underlying bottle lip.

Another object is to provide a scored metal tear-off closure wherein exposure of the scoring to the bottled product is protected against by the annular flowed in sealing gasket.

Still another object is to provide a metal tear-off closure having a structurally reinforced tearing ear to assist opening and protect against damage during high speed closure handling operations.

Other and more detailed objects will in part be obvious and in part pointed out as the description of the invention, taken in conjunction with the accompanying drawing proceeds.

In that drawing:

FIG. 1 is a perspective view of the closure cap in accordance with the invention;

FIG. 2 is a top plan view thereof;

FIG. 3 is a view taken along lines 3—3 in FIG. 2 and looking in the direction of the arrows;

FIG. 4 is an enlarged fragmentary sectional view showing the overlapping relationship between the sealing gasket and the scoring, and FIG. 5 is a perspective view of the closure in torn open position just prior to separation from a bottle.

The closure cap of the invention, generally indicated by number 1 and as shown in FIG. 1 and 2, is formed out of lightweight sheet metal and is seen to comprise a circular top panel 2 surrounded by a radiused juncture portion 3. A cylindrical skirt 4 depends from the juncture portion 3 and terminates in a lowermost free edge 5. The closure cap 1 is provided with a gripping ear 6 extending downwardly from the skirt free edge 5 in a short neck 7 and then extending radially outwardly and downwardly in a base portion 8 which merges into a pull ring 9. A pair of parallel, outwardly embossed reinforcing ribs 10 extend vertically from the base portion 8 across the neck 7 and skirt 4 and terminate at the radiused juncture portion 3. The ribs 10 serve to reinforce the neck 7 and the adjacent skirt portion **4*a* so as to resist detrimental flexure of the gripping ear 6 relative to the cap body as frequently occurs under in-process handling, packing and shipping conditions. This reinforcement is further enhanced by the lowermost extension of the ribs 10 as shown at numeral 11 in FIG. 3, into the bend line 7*a* formed between the neck 7 and the base portion 8 thus impeding flexure of the ring 9 and base portion relative to the neck 7**.

A pair of score lines generally indicated at 12 are formed in the cap body and, for illustration purposes, shown as being formed in the exterior surface of the cap, although interior scoring could also be employed. Each of the score lines commence at a notch 13 formed in the skirt edge 5 at either side of the neck portion 7 and extend upwardly across the cap skirt 4 as indicated at 14. In crossing the radiused juncture portion 3 the score lines flare outwardly away from each other at 15 and blend into a circular path as shown at numeral 16 in FIG. 3 extending part way about the periphery of the cap top panel 2. The radial positioning of the score line portions 16 should remain in close proximity to the top panel periphery as undesirable weakening of the cap during cap forming and cap applying operations can occur when the scoring is positioned around the radiused portion 3. Each score line portion 16 continues along this circular path to a point angularly displaced approximately 45 degrees beyond the cap mid section and then flares radially ourwardly at 17, as the radiused juncture portion 3 is again crossed, terminating at the cap skirt on the opposite side of the cap from the gripping ear.

An annular sealing gasket 18, consisting of a vinyl resin plastisol as a nonlimiting example, is formed in situ within the cap interior so as to be directly adhered to the interior surface of the radiused juncture portion 3. As clearly seen in FIG. 4, the gasket 18 overlaps the circular score line portions 16 by a minor amount with the major portion or mass of the gasket positioned radially outwardly of the score line. This particular gasket placement offers the advantage of protecting the score line area against exposure to the packaged product without resort to costly post-coating operations. Such protection is frequently required where lack of product compatibility may cause a chemical attack on the closure cap base metal and contamination of the packaged product. It should be pointed out that even with scoring on the outside surface of the cap, a certain amount of damage occurs to the interior surface coatings which must still be protected.

A bottle 20 provided with a circumferentially enlarged lip 21 surrounding the bottle neck opening is shown in FIG. 5. The closure cap 1 of the invention is here shown in an intermediate opening position with the cap in torn open condition but prior to complete separation from the underlying bottle lip 21. In addition to the already described advantages resulting from the improved ear reinforcing and score pattern constructional details of the invention, opening and removal of the cap is similarly enhanced. To begin with, a certain amount of tearing resistance is noramlly encountered as the thickest part or mass of the gasket 18 is severed during initial tearing of the cap. As this resistance occurs while tearing proceeds across the radiused junction portion 3, the stiffening effect imparted to the skirt portion 4a by the ribs 10 supplies a highly desirable degree of leverage to the tearing action at this point.

As the tearing action continues into the peripheral score line portions 16, the resistance offered by the gasket 18 is appreciably reduced due to the thinning out of the gasket cross-section along its inner edge overlying the score line. As clearly illustrated in FIG. 5, a small residue of gasketing materal 18a remains along the edges of the upwardly torn center portion of the cap top panel. The presence of this residue indicates the score line has been fully protected from exposure to the bottle contents by being embedded within a minor section of the gasket which is quite readily ruptured in the opening process.

Finally, and perhaps most importantly, the instant score line configuration has been found to make a significant improvement in the ease with which the torn open cap is separated from the bottle. This ease of cap removal comes about by reducing to a minimum the ability of the remaining cap portions to grip the underlying bottle lip 21. With the score pattern herein disclosed, only a narrow band of metal consisting of the skirt portion 4 and the remaining part of the radiused juncture portion 3 is left in engagement with the bottle lip after tearing. Completion of the tearing action occurs when the metal becomes severed along the full extent of the score lines 12 and the terminal points remote from the gripping ear are reached. The normal pulling force applied to the ring 9 then causes the relatively flimsy remaining cap portion to be quite easily dislodged from the underlying bottle lip 21 thus avoiding any undesirable spillage of the bottled product.

From the foregoing it is readily apparent that numerous advantages result from the closure cap of the invention as above described. It should be noted that variations in the cap construction could be employed such as varying the construction or shape of the cap gripping ear. Also different gasketing systems could be employed such as an overall liner adhered or frictionally retained within the cap interior.

Still other changes in an modifications of the construction and different embodiments of the invention would suggest themselves to those skilled in the art and could be made without departing from the spirit or scope of the invention. It is, accordingly, intended that all matter contained in the above description, or shown in the accompanying drawing shall be interpreted as being illustrative and not in the limiting sense.

I claim:

1. A tear-off convenience bottle cap comprising a circular top panel surrounded by a cylindrical skirt terminating in a lowermost free edge, a radiused juncture portion connecting said top panel and said skirt, a ring shaped gripping ear formed as an integral part of said skirt extending downwardly and radially outwardly from said free edge, a tearing zone commencing at said skirt free edge on either side of said gripping ear and extending upwardly across said skirt in an outwardly diverging pattern, each of said tearing zones blending into a circular path lying in close proximity to the periphery of said cap top panel at the commencement of said radiused juncture portion, said tearing zones extending rearwardly from said gripping ear to a point substantially beyond the midsection of said cap top panel and flaring radially outwardly and terminating in close proximity to said cap skirt, whereby the major portion of said cap top panel is separated from said cap skirt upon opening.

2. A tear-off convenience bottle cap as in claim 1, including stiffening means formed in said gripping ear.

3. A tear-off convenience bottle cap comprising a circular top panel surrounded by a cylindrical skirt terminating in a lowermost free edge, a radiused juncture portion connecting said top panel and said skirt, a gripping ear formed as an integral part of said skirt extending downwardly and radially outwardly from said free edge, a tearing zone commencing at said skirt free edge on either side of said gripping ear and extending upwardly across said skirt in an outwardly diverging pattern, each of said tearing zones blending into a path lying in close proximity to the periphery of said cap top panel, a sealing gasket disposed within said cap so as to completely overlie said peripheral paths of said tearing zones, said tearing zones extending rearwardly from said gripping ear to a point substantially beyond the midsection of said cap top panel and flaring radially outwardly and terminating in close proximity to said cap skirt whereby the major portion of said cap top panel is separated from said cap skirt upon opening.

4. A tear-off convenience bottle cap as in claim 3, said sealing gasket being adhesively affixed to the interior of said cap.

5. A tear-off convenience bottle cap comprising a circular top panel surrounded by a cylindrical skirt terminating in a lowermost free edge, a radiused juncture portion connecting said top panel and said skirt, a gripping ear formed as an integral part of said skirt extending downwardly and radially outwardly from said free edge, a tearing zone commencing at said skirt free edge on either side of said gripping ear and extending upwardly across said skirt in an outwardly diverging pattern, each of said tearing zones blending into a path lying in close proximity to the periphery of said cap top panel, said tearing zones extending rearwardly from said gripping ear so as to partially surround said cap top panel and an annular sealing gasket adhesively affixed to said cap interior so as to completely overlie said tearing zones along said path whereby removal of said cap causes tearing of said gasket along said path.

6. A tear-off convenience closure as in claim 5, the mass of said sealing gasket being disposed radially outwardly of said tearing zone path.

7. A tear-off convenience bottle cap comprising a circular top panel surrounded by a cylindrical skirt terminating in a lowermost free edge, a radiused juncture portion connecting said top panel and said skirt, a gripping ear formed as an integral part of said skirt extending from said free edge, a tearing zone commencing at said skirt free edge adjacent said gripping ear and extending upwardly across said skirt and blending into a path lying in close proximity to the periphery of said cap top panel, said tearing zone extending rearwardly from said gripping ear to at least partially surround said cap top panel and an annular sealing gasket adhesively affixed to said cap interior so as to completely overlie said tearing zone along said path with the mass of said sealing gasket being disposed radially outwardly of said tearing zone path and leaving a thinned out section of sealing gasket overlying said tearing zone path whereby removal of said cap causes tearing of said gasket along said path.

* * * * *

Notice of Adverse Decision in Interference

In Interference No. 100,243, involving Patent No. 3,974,931, T. G. Moller, BOTTLE CAP, final judgment adverse to the patentee was rendered Apr. 23, 1982, as to claim 7.

[*Official Gazette July 12, 1983.*]